US006969163B2

(12) United States Patent
Studer et al.

(10) Patent No.: US 6,969,163 B2
(45) Date of Patent: Nov. 29, 2005

(54) INK-RESERVOIR VENTS AND VENTING METHODS

(75) Inventors: Anthony D. Studer, Albany, OR (US); Kevin D. Almen, Albany, OR (US); David J. Benson, Albany, OR (US); Cary R. Bybee, Lebanon, OR (US); David M. Hagen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 28 days.

(21) Appl. No.: 10/634,317

(22) Filed: Aug. 5, 2003

(65) Prior Publication Data

US 2005/0030355 A1 Feb. 10, 2005

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | | |
|---|---|---|---|---|
| 4,806,032 A | | 2/1989 | Gragg | |
| 5,025,271 A | | 6/1991 | Baker et al. | |
| 5,642,144 A | | 6/1997 | Plotkin | |
| 5,784,088 A | * | 7/1998 | Ujita et al. | 347/86 |
| 5,801,737 A | * | 9/1998 | Sato et al. | 347/86 |
| 6,145,974 A | | 11/2000 | Shinada | |
| 6,247,804 B1 | * | 6/2001 | Watanabe | 347/86 |
| 6,273,561 B1 | | 8/2001 | Ahn | |
| 6,332,676 B1 | | 12/2001 | Santhanam | |
| 6,402,306 B1 | * | 6/2002 | Childers et al. | 347/85 |
| 6,692,119 B2 | * | 2/2004 | Yu et al. | 347/86 |
| 6,776,479 B2 | * | 8/2004 | Ardito et al. | 347/86 |
| 2002/0140788 A1 | | 10/2002 | Usui | |
| 2002/0196317 A1 | | 12/2002 | Santhanam et al. | |
| 2003/0007042 A1 | | 1/2003 | Lu | |
| 2003/0058315 A1 | | 3/2003 | Lee | |

FOREIGN PATENT DOCUMENTS

WO WO 96/04141 2/1996

* cited by examiner

*Primary Examiner*—Anh T. N. Vo

(57) ABSTRACT

Ink reservoirs and methods are provided. One ink reservoir has at least one compartment and first and second vents that communicatively couple the compartment to an atmosphere surrounding an exterior of the ink reservoir.

24 Claims, 5 Drawing Sheets

INK-RESERVOIR VENTS AND VENTING METHODS

BACKGROUND

Imaging devices, such as printers, facsimile machines, etc., often employ a print head for printing on a printable medium, such as paper. Ink is usually supplied to the print head from an ink reservoir via a flow passage. In one application, the ink reservoir and print head form a single unit, e.g., a print cartridge, and ink flows from the ink reservoir to the print head via the flow passage during printing. In another example, the ink reservoir and print head are separate, and during printing, ink flows from the ink reservoir to the print head via a flexible duct interconnecting the ink reservoir and the print head. Many print heads, such as used in ink-jet devices, include resistors that vaporize the ink supplied to the print head. This causes the ink to be ejected through orifices of the print head so as to print dots of ink on the printable medium.

To prevent ink leakage from the reservoir, it is common to exert a force on the ink to retain the ink within the ink reservoir. For example, many ink reservoirs contain a capillary medium, such as foam (or an ink sponge), that is capable of absorbing and retaining ink. The capillarity of the capillary medium exerts a force (capillary force) that draws the ink into the capillary medium, preventing the ink from leaking out of the capillary medium and thus the reservoir. Many ink reservoirs initially contain enough ink to wet the capillary medium up to a percentage of the height of the capillary medium above the bottom of the capillary medium, e.g., 75 to 95 percent, with the remaining upper portion of the capillary medium containing air, for example. Moreover, ink reservoirs often include an air-filled space between the top of the capillary medium and a cover of the ink reservoir.

Capillary medium-based ink reservoirs are typically vented to atmospheric pressure to prevent excessive vacuum pressures within the reservoir that can reduce or prevent ink flow to the print head, e.g., by a vent disposed in the cover of the ink reservoir. In this situation, air flows through the vent from an atmosphere surrounding an exterior of the ink reservoir to an interior of the ink reservoir. In addition, venting relieves pressure buildups that can occur when an ink reservoir is exposed to extreme environmental conditions, e.g., that can be encountered during shipping, such as high temperatures in motor vehicles or low pressures in airplanes at high altitudes. In this situation, air flows through the vent from the interior of ink reservoir to the atmosphere surrounding the exterior of the ink reservoir.

In some situations, air becomes trapped in the capillary medium, e.g., while adding ink to the ink reservoir, forming air pockets or voids within the capillary medium. This problem is amplified for applications involving hydrophilic capillary media because hydrophilic capillary media normally do not require a vacuum during filling. Moreover, when the ink reservoir is subjected to stresses, e.g. during shipping and/or handling, such as dropping the ink reservoir, the volume of entrapped air can increase or air from the space above the capillary medium can be displaced into the capillary medium. The air within the capillary medium causes problems when the ink reservoir is exposed to high temperatures and/or low pressures. In particular, the high temperatures and/or low pressures cause the air within the capillary medium to expand, forcing ink out of the vent instead of air.

SUMMARY

One embodiment of the present invention provides an ink reservoir having at least one compartment and first and second vents that communicatively couple the compartment to an atmosphere surrounding an exterior of the ink reservoir.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1:
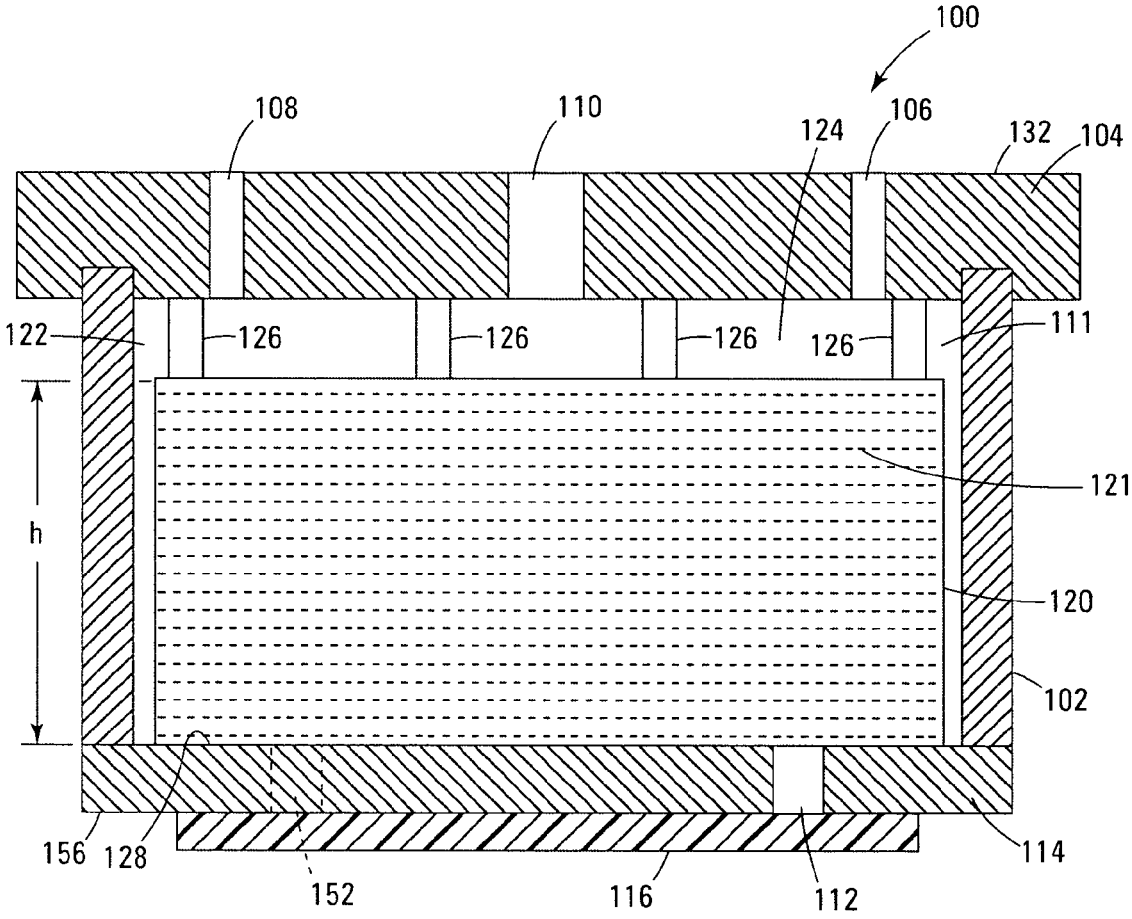
FIG. 1 is a cross-sectional view of an ink reservoir according to an embodiment of the present invention.

FIG. 1 is a cross-sectional view of an ink reservoir 100 according to an embodiment of the present invention. For one embodiment, ink reservoir 100 is a single-ink reservoir or a single-ink compartment of a multi-compartment, multi-color ink reservoir. Ink reservoir 100 includes a body 102 and a cover 104 disposed on body 102. Cover 104 may be attached to body 102 by gluing, fasteners, or the like, or may be integral with body 102. Vent holes 106 and 108 and a fill-hole 110 pass completely through cover 104 into a compartment 111 located in an interior 122 of ink reservoir 100. For one embodiment, compartment 111 is one of a number of isolated compartments (not shown) for containing a single-color ink of a multi-compartment, multi-color ink reservoir, one of a number of communicating compartments of a multi-compartment, single-color ink reservoir, or is a single-compartment of single-color ink reservoir. An outlet (or interconnect) port 112 passes completely through a wall 114 of body 102 that is opposite cover 104. In one embodiment, a seal 116, e.g., a label, tape, or the like affixed to an exterior surface 156 of wall 114, is disposed over outlet port 112 for closing outlet port 112, for example, when ink reservoir 100 is being shipped, stored prior to usage, etc. Seal 116 is removed for printing.

A capillary medium 120 is located in compartment 111 of ink reservoir 100. Capillary medium 120 is adapted to contain ink and to act to prevent the ink from leaking through outlet port 112 when seal 116 is removed. In particular, capillary medium 120 has a capillarity that exerts a capillary force on the ink that acts to prevent the ink from leaking through outlet port 112. For various embodiments, capillary medium 120 is a hydrophilic material, such as bonded polyester fiber, bonded polyolefin fiber, or the like that have a fiber direction substantially perpendicular to the vent holes 106 and 108, as shown by dashed lines 121 in FIG. 1. Using a hydrophilic material for the capillary medium often simplifies the ink-fill process because a vacuum is normally not required during filling, as for hydrophobic material. Moreover, hydrophilic materials are typically more chemically inert, and thus more ink resistant, than hydrophobic materials.

In one embodiment, a gap 124 separates cover 104 from capillary medium 120. In another embodiment, spacers 126 are located within gap 124 and extend between cover 104 and capillary medium 120. For one embodiment, spacers 126 are in the form of castellations integral with cover 104. Spacers 126 enable air from vent holes 106 and 108 to move into capillary medium 120 to replace ink as the ink is withdrawn from ink reservoir 100 during printing. For another embodiment, capillary medium 120 contacts an interior surface 128 of wall 114, as shown in FIG. 1.

Figure 2:
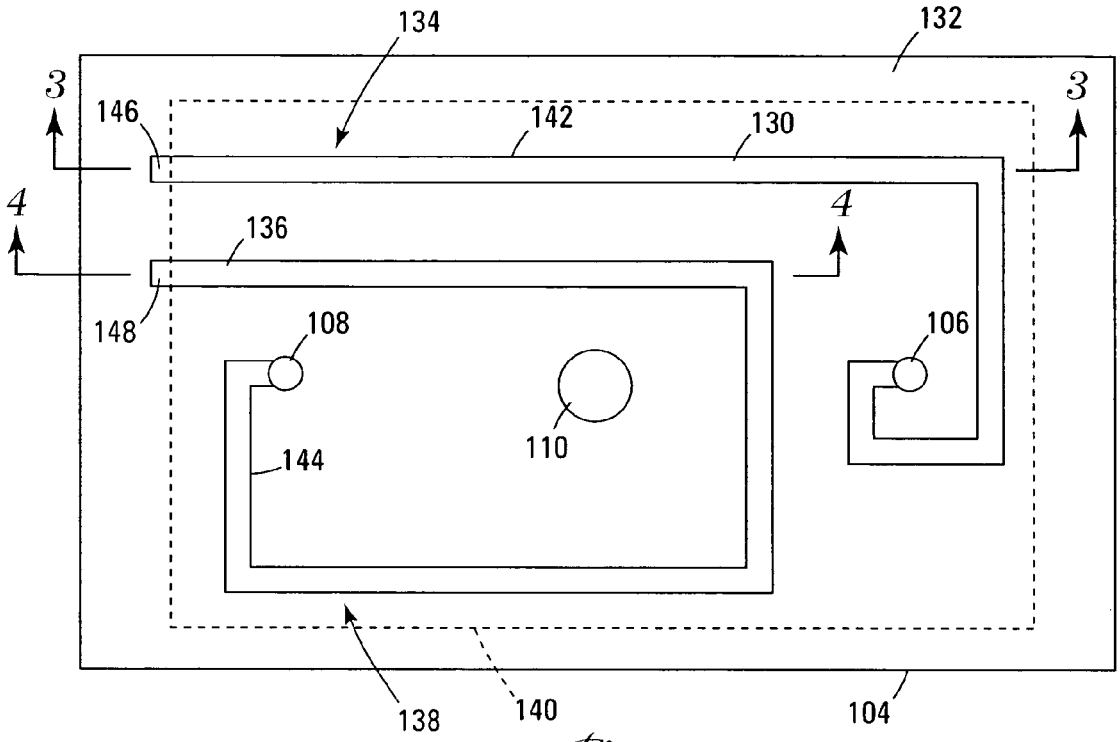
FIG. 2 is a top view illustrating a cover of an ink reservoir according to another embodiment of the present invention.
Figure 3:
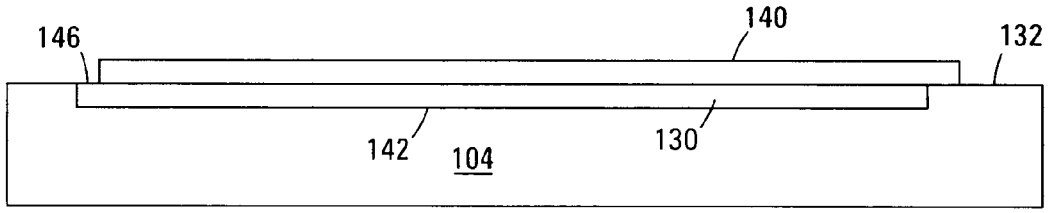
FIGS. 3 and 4 are views respectively taken along lines 3—3 and 4—4 of FIG. 2.
Figure 4:
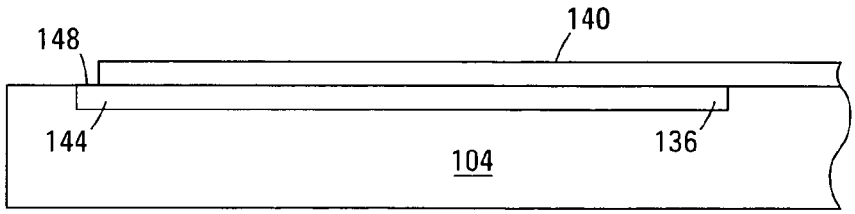

FIG. 2 is a top view illustrating cover 104 according to another embodiment of the present invention. FIGS. 3 and 4 are views respectively taken along lines 3—3 and 4—4 of FIG. 2. For some embodiments, a groove 130 disposed in an exterior surface 132 of cover 104 is connected to vent hole 106. For one embodiment, groove 130 has a serpentine shape, as shown in FIG. 2. For another embodiment, groove 130 and vent hole 106 form a labyrinth vent 134. Groove 130 acts to reduce ink evaporation, e.g., water vapor transmission from the ink. For other embodiments, a groove 136 disposed in exterior surface 132 is connected to vent hole 108. For one embodiment, groove 136 has a serpentine shape, as shown in FIG. 2. For another embodiment, groove 136 and vent hole 108 form a labyrinth vent 138. Like groove 130, groove 136 acts to reduce ink evaporation.

A seal 140 (denoted by dashed lines in FIG. 2) is disposed on cover 104, e.g., a label, tape, or the like affixed to exterior surface 132 of cover 104, so as to close vent holes 106 and 108 at exterior surface 132. Seal 140 also closes an open side of grooves 130 and 136 to form elongated vent paths 142 and 144 that are connected to and extend from vent holes 106 and 108, respectively. However, seal 140 does not cover the entire extent of grooves 130 and 136. Rather, portions 146 and 148 respectively of grooves 130 and 136 remain open to an atmosphere surrounding an exterior of ink reservoir 100 and thus portions 146 and 148 respectively form openings to vent paths 142 and 144, as shown in FIG. 2. Therefore, vent paths 142 and 144 communicatively couple vent holes 106 and 108, respectively, to the atmosphere surrounding the exterior of ink reservoir 100. For one embodiment, vent paths 142 and 144 have a serpentine shape. For another embodiment, vent paths 142 and 144 are substantially perpendicular to vent holes 106 and 108, respectively.

Ink reservoir 100 initially contains enough ink to wet capillary medium 120, e.g., up to about 75 to 95 percent of its height h. The remainder of capillary medium 120 and gap 124 contain air. However, capillary medium 120 may contain air pockets, e.g., formed while adding ink to the ink reservoir 100 or displaced from gap 124 if the ink reservoir 100 is subjected to stresses.

During operation, seal 116 is removed from outlet port 112, and ink is withdrawn from ink reservoir 100 through outlet port 112. For one embodiment, as the ink is withdrawn, the pressure in the atmosphere surrounding the exterior of the ink reservoir exceeds the pressure in compartment 111, and labyrinth vents 134 and 138 respectively direct first and second flows of external ambient air, for one embodiment, substantially simultaneously into ink reservoir 100 to replace the withdrawn ink. Specifically, the air flows from the atmosphere surrounding the exterior of ink reservoir 100 through the openings to vent paths 142 and 144, along cover 104 through vent paths 142 and 144, through vent holes 106 and 108, and into compartment 111 of ink reservoir 100. This acts to prevent excessive vacuum pressures within reservoir 100 that can reduce or prevent ink flow from reservoir 100.

When the air is caused to expand, e.g., when ink reservoir 100 is exposed to sufficiently high temperatures or low pressures, labyrinth vents 134 and 138 act to evenly distribute pressure within gap 124 so that ink is not forced through labyrinth vents 134 and 138 by expanding air. In this situation, the pressure within compartment 111 exceeds the pressure in the atmosphere surrounding the exterior of ink reservoir 100, and labyrinth vents 134 and 138 respectively direct first and second air flows of the expanding air, for one embodiment, substantially simultaneously from compartment 111 to the exterior of ink reservoir 100. Specifically, expanding air within compartment 111 flows from compartment 111 through vent holes 106 and 108, vent paths 142 and 144, and the openings to vent paths 142 and 144 to the exterior of ink reservoir 100. This acts to reduce the pressure within ink reservoir 100.

Figure 5:
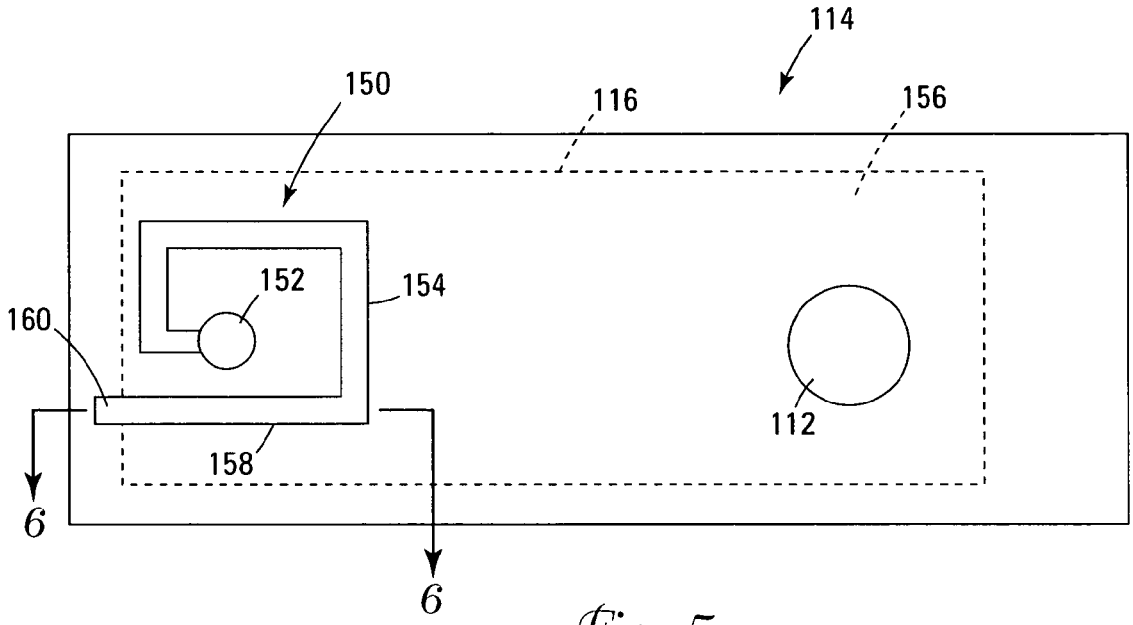
FIG. 5 is a bottom view of an ink reservoir according to another embodiment of the present invention.
Figure 6:
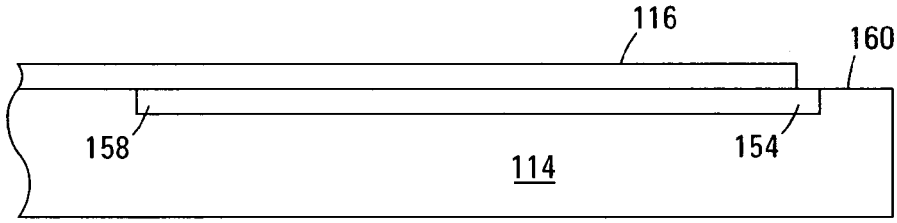
FIG. 6 is a view taken along line 6—6 of FIG. 5.

For some embodiments, a labyrinth vent 150 is disposed in wall 114 of body 102, as illustrated in FIG. 5, a bottom view of ink reservoir 100, and FIG. 6, a view taken along line 6—6 of FIG. 5. Labyrinth vent 150 includes a vent hole 152 that passes completely through wall 114 into compartment 111, as indicated by dashed lines in FIG. 1. For one embodiment, vent hole 152 is substantially perpendicular to the fiber direction of capillary medium 120. A groove 154 disposed in an exterior surface 156 of wall 114 is connected to vent hole 152. For one embodiment, groove 154 has a serpentine shape, as shown in FIG. 5. Seal 116 closes vent hole 152 at exterior surface 156. Seal 116 also closes an open side of groove 154 to form an elongated vent path 158 that is connected to and extends from vent hole 152. However, seal 116 does not cover the entire extent of groove 154. Rather, a portion 160 of groove 154 remains open to the atmosphere surrounding the exterior of ink reservoir 100 and thus portion 160 forms an opening to vent path 158, as shown in FIGS. 5 and 6. Therefore, vent path 158 communicatively couples vent hole 152 to the atmosphere surrounding the exterior of ink reservoir 100. For one embodiment, vent path 158 has a serpentine shape. For another embodiment, vent path 158 is substantially perpendicular to vent hole 152.

For one embodiment reservoir 100 includes at least two of labyrinth vents 134, 138, and 150. Specifically, reservoir 100 may include all of labyrinth vents 134, 138, and 150, only labyrinth vents 134 and 138, or labyrinth vent 150 and either labyrinth vent 134 or labyrinth vent 138.

During operation, seal 116 is removed from outlet port 112, but not from groove 154 or vent hole 152, and ink is withdrawn from ink reservoir 100 through outlet port 112. As the ink is withdrawn, labyrinth vent 134 and/or labyrinth vent 138 and labyrinth vent 150 respectively direct flows of external ambient air, for one embodiment, substantially simultaneously into compartment 111 to replace the withdrawn ink. This acts to prevent excessive vacuum pressures within reservoir 100 that can reduce or prevent ink flow from reservoir 100. The air flowing through labyrinth vent 150 flows from the atmosphere surrounding the exterior of ink reservoir 100 through the opening to vent path 158, along wall 114 through vent path 158, through vent hole 152, and into compartment 111 of ink reservoir 100. The air flows through labyrinth vent 134 and/or labyrinth vent 138 as described above.

When the air is caused to expand, e.g., when ink reservoir 100 is exposed to sufficiently high temperatures or low pressures, labyrinth vent 134 and/or labyrinth vent 138 and labyrinth vent 150 act to distribute pressure within ink reservoir 100 so that ink is not forced through labyrinth vent 134 and/or labyrinth vent 138 and labyrinth vent 150 by expanding air. Labyrinth vent 134 and/or labyrinth vent 138 and labyrinth vent 150 respectively direct flows of the expanding air from compartment 111, for one embodiment, substantially simultaneously to the atmosphere surrounding the exterior of ink reservoir 100.

Using multiple vents, such as at least two of labyrinth vents 134, 138, and 150, acts to distribute pressure within compartment 111, and particularly in gap 124, more evenly than a single vent. This acts to prevent ink from flowing into vents 134 and 138 instead of air when the air is caused to expand. Moreover, multiple vents provide more vent area, which acts to relieve the pressure within compartment 111 when the air is caused to expand. Multiple vents also act to reduce ink evaporation compared to a single vent having the same surface area as the multiple vents.

Figure 7:
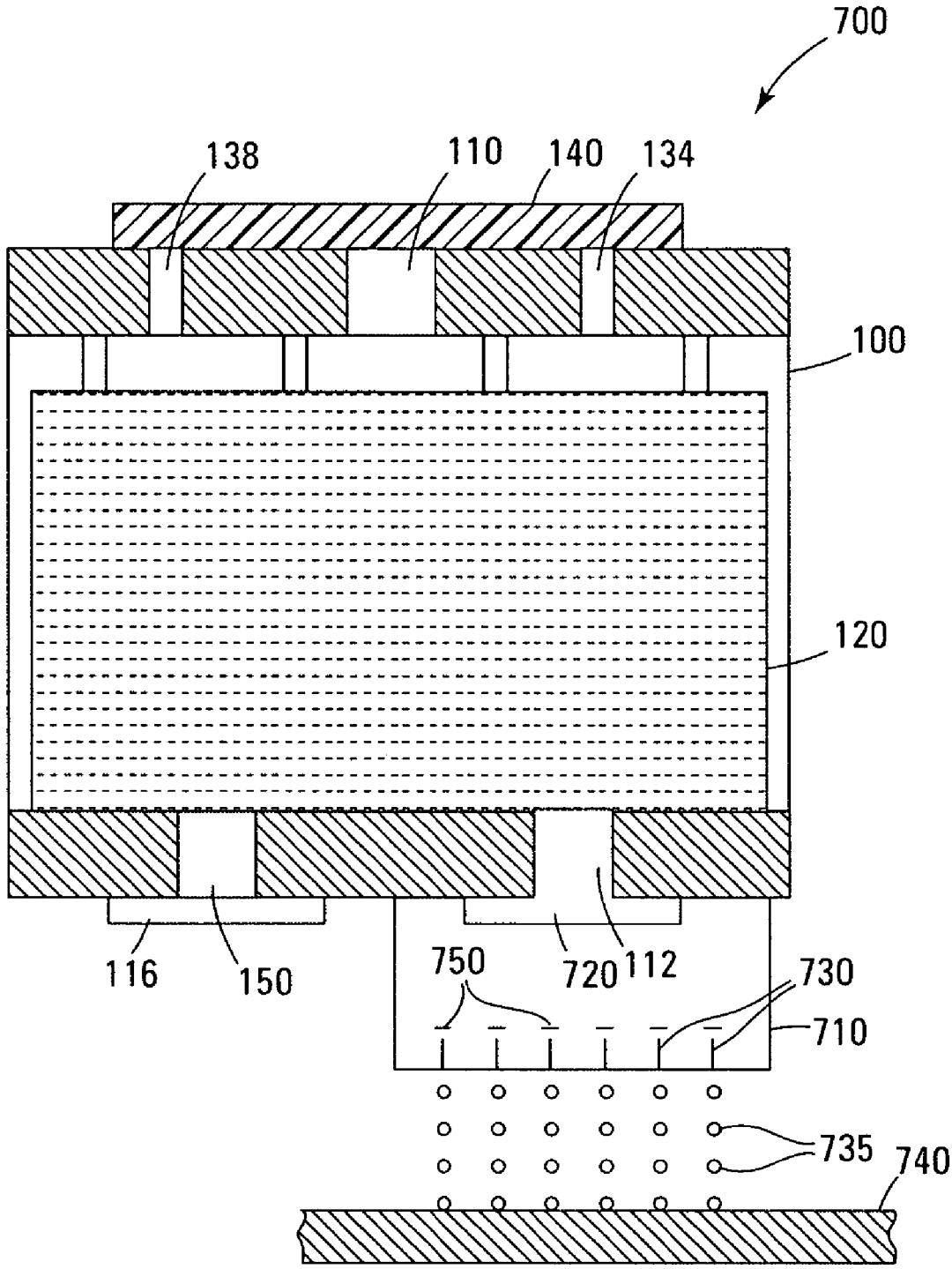
FIG. 7 is a cross-sectional view of a print cartridge according to another embodiment of the present invention.

FIG. 7 is a cross-sectional view of an ink (or print) cartridge 700 according to another embodiment of the present invention. Elements that are common to FIGS. 1–6 and 7 are numbered as in FIGS. 1–6 and are as described above. Print cartridge 700 includes a print head 710, e.g., an ink-jet print head, that in one embodiment is integral with ink reservoir 100. Print head 710 is fluidly coupled to outlet port 112 of ink reservoir 100 by a manifold 720, for example. For one embodiment, ink reservoir 100 includes at least two of labyrinth vents 134, 138, and 150. Print head 710 includes orifices 730 for expelling the ink supplied to print head 710, in the form of ink droplets 735, for printing on a printable medium 740, e.g., paper, when print cartridge 700 is carried over printable medium 740 by movable carriage (not shown) of an imaging device (not shown), such as a printer, fax machine, or the like. In another embodiment, the ink is expelled through orifices 730 by vaporizing the ink using resistors 750 located within print head 710. In another embodiment, the capillarity of capillary medium 120 exerts a capillary force on the ink that acts to prevent the ink from leaking through outlet port 112 and thus through orifices 730.

As the ink is expelled, air is drawn into ink reservoir 100 through at least two of labyrinth vents 134, 138, and 150 to replace the expelled ink. Air is expelled through at least two of labyrinth vents 134, 138, and 150 in the event the air is caused to expand within print cartridge 100.

Figure 8:
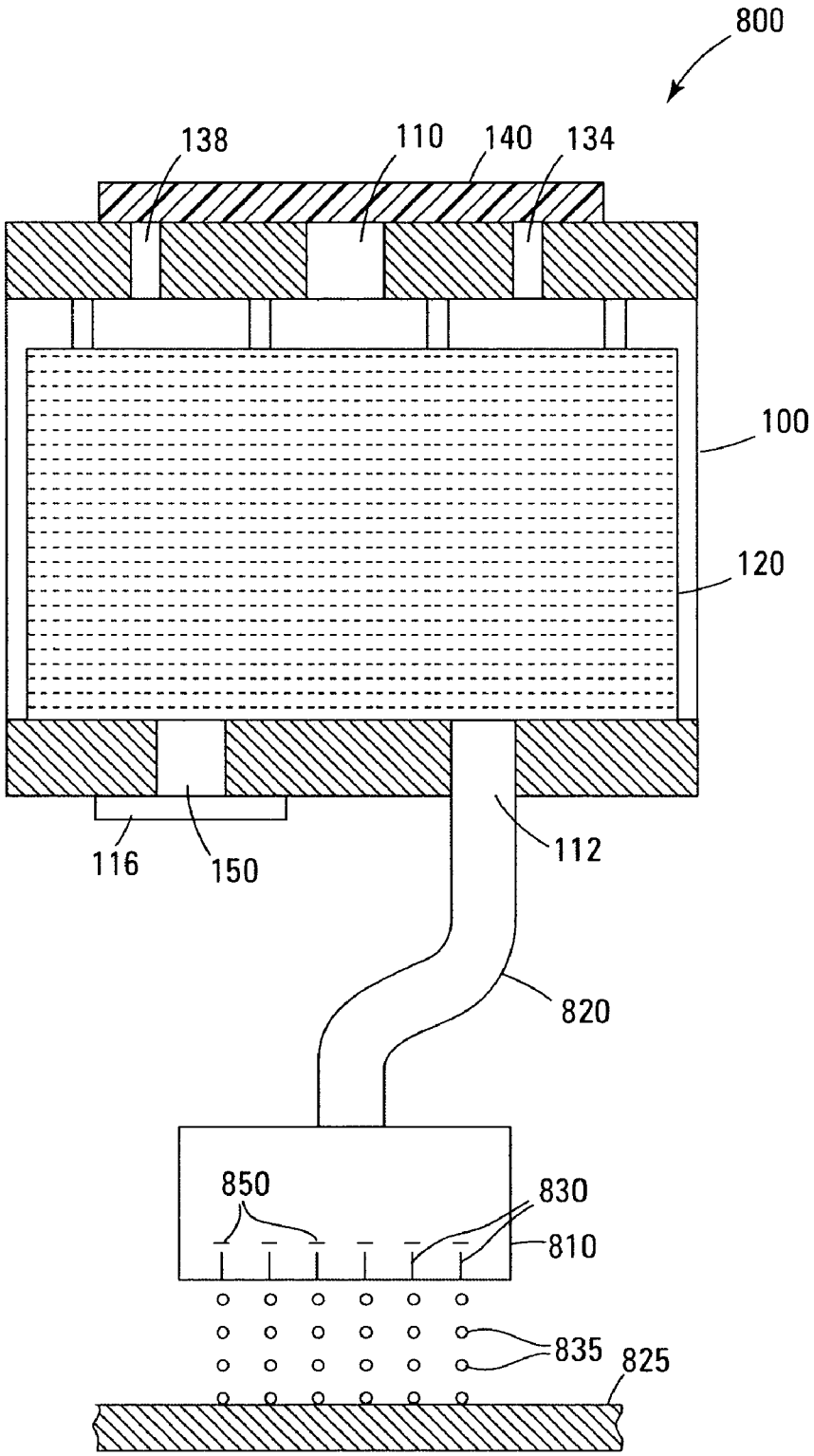
FIG. 8 is a cross-sectional view of an ink-deposition system according to another embodiment of the present invention.

FIG. 8 is a cross-sectional view of an ink-deposition system 800 according to another embodiment of the present invention. Elements that are common to FIGS. 1–6 and 8 are numbered as in FIGS. 1–6 and are as described above. Ink-deposition system 800 includes a print head 810, e.g., an ink-jet print head, fluidly coupled to outlet port 112 of ink reservoir 100 by a flexible conduit 820, such as plastic or rubber tubing or the like. For one embodiment, ink reservoir 100 includes at least two of labyrinth vents 134, 138, and 150.

For one embodiment, print head 810 is attached to a movable carriage (not shown) of an imaging device (not shown), such as a printer, fax machine, or the like, while ink reservoir 100 is fixed to the imaging device remotely to print head 810. During printing, print head 810 moves across printable medium 825, such as paper, to deposit images on printable medium 825, while ink reservoir 100 remains stationary. Flexible conduit 820 enables print head 810 to move relative to ink reservoir 100.

Print head 810 includes orifices 830 for expelling the ink supplied to print head 810, in the form of ink droplets 835, for printing on printable medium 825. In another embodiment, the ink is expelled through orifices 830 by vaporizing the ink using resistors 850 located within print head 810. In another embodiment, the capillarity of capillary medium 120 exerts a capillary force on the ink that acts to prevent the ink from leaking through outlet port 112 and thus through orifices 830.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. An ink reservoir comprising:

at least one compartment; and first and second vents that communicatively couple an interior of the compartment to an atmosphere surrounding an exterior of the ink reservoir;

wherein the first vent is disposed in a cover of the ink reservoir and the second vent passes through a wall of the ink reservoir that is opposite the cover and is in addition to an interconnect port passing through the wall; and wherein the first and second vents remain open to the atmosphere.

2. The ink reservoir of claim 1, further comprising a capillary medium located within the compartment for containing ink and acting to prevent the ink from leaking through the interconnect port.

3. The ink reservoir of claim 2, wherein the capillary medium is of a hydrophilic material.

4. The ink reservoir of claim 3, wherein a fiber direction of the hydrophilic material is substantially perpendicular to the first and second vents.

5. The ink reservoir of claim 1, wherein the first and second vents are labyrinth vents.

6. The ink reservoir of claim 1, further comprising a third vent disposed in the cover, wherein the third vent communicatively couples the compartment to the atmosphere surrounding the exterior of the ink reservoir.

7. An ink reservoir comprising:

at least one compartment; and first and second labyrinth vents, the first and second labyrinth vents respectively comprising first and second vent holes passing through the ink reservoir and into the compartment and first and second elongated vent paths that respectively communicatively couple the first and second vent holes to an atmosphere surrounding an exterior of the ink reservoir;

wherein the first vent hole passes through a cover of the ink reservoir and the second vent hole passes through a wall of the ink reservoir that is opposite the cover; and wherein the second elongated vent path is formed in an exterior surface of the wall, and wherein the first and second vents remain open to the atmosphere.

8. The ink reservoir of claim 7, further comprising a capillary medium located within the compartment for containing ink and acting to prevent the ink from leaking through an outlet of the ink reservoir.

9. The ink reservoir of claim 7, wherein the first elongated vent path comprises a first groove disposed in the cover closed by a first seal and second elongated vent paths comprises a second groove disposed in exterior surface of the wall.

10. The ink reservoir of claim 9, wherein the first seal closes the first vent hole at an exterior surface of the cover and the second seal closes the second vent holes at the exterior surface of the wall.

11. The ink reservoir of claim 7, further comprising a third labyrinth vent disposed in the cover of the ink reservoir, the third labyrinth vent comprising a third vent hole passing through the cover of the ink reservoir and into the compartment and a third elongated vent path that communicatively couples the third vent hole to the atmosphere surrounding the exterior of the ink reservoir.

12. An ink reservoir comprising:

means for directing a first airflows into a compartment of the ink reservoir through a cover of the ink reservoir from an atmosphere surrounding an exterior of the ink reservoir when a pressure of the atmosphere is greater than a pressure in the compartment and from the compartment to the atmosphere through the cover when the pressure of the atmosphere is less than the pressure in the compartment; and means for directing a second airflow into the compartment through a wall of the ink reservoir that is opposite the cover, substantially simultaneously with the first airflow, from the atmosphere when the pressure of the atmosphere is greater than the pressure in the compartment and from the compartment to the atmosphere through the wall, substantially simultaneously with the first airflow, when the pressure of the atmosphere is less than the pressure in the compartment, wherein the second airflow directing means is separate from an interconnect port passing through the wall, and wherein the first and second airflows remain open to the atmosphere.

13. The ink reservoir of claim 12, wherein the first airflow directing means comprises one or more first vents in the cover.

14. The ink reservoir of claim 13, wherein the second airflow directing means-comprises a second vent in the wall.

15. An ink-deposition system comprising:

a print head; and an ink reservoir fluidly coupled to the print head, the ink reservoir comprising:

at least one compartment; and first and second vents that communicatively couple the compartment to an atmosphere surrounding an exterior of the ink reservoir;

wherein the first vent is disposed in a cover of the ink reservoir and the second vent passes through a wall of the ink reservoir that is opposite the cover and is in addition to an interconnect port passing through the wall, and wherein the first and second vents remain open to the atmosphere.

16. The ink-deposition system of claim 15 further comprises a capillary medium located within the compartment for containing ink and acting to prevent the ink from leaking through orifices of the print head.

17. The ink-deposition system of claim 16, wherein the capillary medium is of a hydrophilic material.

18. The ink-deposition system of claim 15, further comprising a third vent disposed in the cover, wherein the third vent communicatively couples the compartment to the atmosphere surrounding the exterior of the ink reservoir.

19. The ink-deposition system of claim 15, wherein a flexible conduit fluidly couples the ink reservoir to the print head.

20. A method for venting an ink reservoir, the method comprising:

passing a first vent hole through a cover of the ink reservoir into a compartment of the ink reservoir;

forming a first elongated vent path in the cover between an atmosphere surrounding an exterior of the ink reservoir and the first vent hole for communicatively coupling the first vent hole to the atmosphere;

passing a second vent hole through a wall of the ink reservoir opposite the cover into the compartment; and forming a second elongated vent path in an exterior surface of the wall between the atmosphere and the second vent hole for communicatively coupling the second vent hole to the atmosphere, and wherein the first and second vent holes remain open to the atmosphere.

21. The method of claim 20, further comprising:

passing a third vent hole through the cover into the compartment of the ink reservoir; and forming a third elongated vent path in the cover between the atmosphere and the third vent hole for communicatively coupling the third vent hole to the atmosphere.

22. A method for venting an ink reservoir, the method comprising:

directing first and second airflows substantially simultaneously into a compartment of the ink reservoir from an atmosphere surrounding an exterior of the ink reservoir when a pressure of the atmosphere is greater than a pressure in the compartment wherein the first airflow is directed through a cover of the ink reservoir and the second airflow is directed through a wall of the ink reservoir opposite the cover and not through an interconnect port in the wall; and directing the first and second airflows substantially simultaneously from the compartment to the atmosphere when the pressure of the atmosphere is less than the pressure in the compartment, and wherein the first and second airflows remain open to the atmosphere.

23. The method of claim 22, wherein:

directing the first airflow comprises directing the first airflow through a first labyrinth vent disposed in the cover of the ink reservoir; and directing the second air flow comprises directing the second airflow through a second labyrinth vent disposed in the wall of the ink reservoir.

24. The method of claim 22, further comprising:

directing a third airflow into the compartment from the atmosphere substantially simultaneously with the first and second airflows when a pressure of the atmosphere is greater than a pressure in the compartment; and directing the third airflow from the compartment to the atmosphere substantially simultaneously with the first and second airflows when the pressure of the atmosphere is less than the pressure in the compartment;

wherein directing the third airflow comprises directing the third airflow through a third vent disposed in the cover.

* * * * *